US006729572B2

(12) United States Patent
Baggot et al.

(10) Patent No.: US 6,729,572 B2
(45) Date of Patent: May 4, 2004

(54) MANDRELLESS CENTER/SURFACE REWINDER AND WINDER

(75) Inventors: James L. Baggot, Menasha, WI (US); Robert L. Clarke, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 22 days.

(21) Appl. No.: 10/003,715

(22) Filed: Oct. 31, 2001

(65) Prior Publication Data

US 2003/0080234 A1 May 1, 2003

(51) Int. Cl.[7] ..... B65H 18/08; B65H 20/06

(52) U.S. Cl. ..... 242/532.2; 242/533.6; 242/535.4; 242/541.3

(58) Field of Search ..... 242/532.2, 532.3, 242/527.1, 533.5, 533.6, 535.4, 541.3; 198/803.12

(56) References Cited

U.S. PATENT DOCUMENTS

| | | | | |
|---|---|---|---|---|
| 125,597 | A | 4/1872 | Mayall | |
| 1,648,990 | A | 11/1927 | Little | |
| 1,894,253 | A | 1/1933 | McCarthey et al. | |
| 2,326,173 | A | 8/1943 | Russell | |
| 3,123,315 | A | 3/1964 | Couzens | |
| 3,148,843 | A | 9/1964 | Turner et al. | |
| 3,157,371 | A | 11/1964 | Billingsley | |
| 3,315,908 | A | 4/1967 | Wetzler | |
| 3,430,881 | A | 3/1969 | Ebneter | |
| 3,519,214 | A * | 7/1970 | Konrad et al. | 242/535.4 |
| 3,869,095 | A | 3/1975 | Diltz | |
| 4,034,928 | A | 7/1977 | McDonald et al. | |
| 4,087,319 | A | 5/1978 | Linkletter | |
| 4,133,495 | A | 1/1979 | Dowd | |
| 4,139,164 | A | 2/1979 | Alfio | |
| 4,143,828 | A | 3/1979 | Braun et al. | |
| 4,191,341 | A | 3/1980 | Looser | |
| 4,283,023 | A | 8/1981 | Braun et al. | |
| 4,327,876 | A | 5/1982 | Kuhn | |
| 4,529,141 | A | 7/1985 | McClenathan | |
| 4,541,583 | A | 9/1985 | Forman et al. | |
| 4,583,698 | A | 4/1986 | Nistri et al. | |
| 4,588,138 | A | 5/1986 | Spencer | |
| 4,723,724 | A | 2/1988 | Bradley | |
| 4,856,725 | A | 8/1989 | Bradley | |
| 4,930,711 | A | 6/1990 | Morizzo | |
| 4,962,897 | A | 10/1990 | Bradley | |
| 4,988,052 | A | 1/1991 | Urban | |
| 5,169,084 | A | 12/1992 | Potter et al. | |
| 5,226,612 | A | 7/1993 | Mülfarth | |
| 5,346,150 | A | 9/1994 | Volin | |
| 5,379,964 | A | 1/1995 | Pretto et al. | |

(List continued on next page.)

FOREIGN PATENT DOCUMENTS

| | | |
|---|---|---|
| CH | 476620 | 8/1969 |
| DE | 3920659 A1 | 1/1999 |
| EP | 0118384 A1 | 9/1984 |

(List continued on next page.)

OTHER PUBLICATIONS

World Intellectual Property Organization Ser. No. WO 02/055420, Jul. 18, 2002.

(List continued on next page.)

*Primary Examiner*—William A. Rivera
(74) *Attorney, Agent, or Firm*—Dority & Manning, P.A.

(57) ABSTRACT

A rewinder for winding a web to produce a rolled product. The rewinder includes a web transfer device that is used for conveying the web. The web transfer device communicates with a core in order to wind the web via surface winding. At least one pair of rotationally driven end chucks are located proximate to the web transfer device. The end chucks engage the core and the web is wound onto the core via center winding by the rotating end chucks. Also, the web is wound onto the core to form a rolled product by a combination of the center winding and the surface winding.

29 Claims, 9 Drawing Sheets

U.S. PATENT DOCUMENTS

| | | | | |
|---|---|---|---|---|
| 5,402,960 | A | | 4/1995 | Oliver et al. |
| 5,421,536 | A | | 6/1995 | Hertel et al. |
| 5,437,417 | A | | 8/1995 | Kammann |
| 5,497,959 | A | | 3/1996 | Johnson et al. |
| 5,505,402 | A | | 4/1996 | Vigneau |
| 5,518,200 | A | | 5/1996 | Kaji et al. |
| 5,531,396 | A | | 7/1996 | Kinnunen et al. |
| 5,593,545 | A | | 1/1997 | Rugowski et al. |
| 5,746,379 | A | * | 5/1998 | Shimizu ..... 242/532.2 |
| 5,832,696 | A | | 11/1998 | Nagy et al. |
| 5,839,688 | A | | 11/1998 | Hertel et al. |
| 5,855,337 | A | * | 1/1999 | Schonmeier et al. ..... 242/542 |
| 5,901,918 | A | | 5/1999 | Klerelid et al. |
| 5,918,830 | A | * | 7/1999 | Verajankorva et al. ... 242/532.2 |
| 5,944,273 | A | | 8/1999 | Lin et al. |
| 5,979,818 | A | | 11/1999 | Perini et al. |
| 6,056,229 | A | | 5/2000 | Blume et al. |
| 6,062,507 | A | | 5/2000 | Summey, III |
| 6,142,407 | A | | 11/2000 | McNeil et al. |
| 6,264,132 | B1 | | 7/2001 | Menz et al. |
| 6,283,402 | B1 | | 9/2001 | Fordham |
| 6,523,775 | B2 | | 2/2003 | Fan |

FOREIGN PATENT DOCUMENTS

| | | | |
|---|---|---|---|
| EP | 0135662 | A2 | 4/1985 |
| EP | 0198495 | A2 | 10/1986 |
| EP | 0313859 | A2 | 5/1989 |
| EP | 0408526 | B1 | 1/1991 |
| EP | 1076130 | A2 | 2/2001 |
| FR | 2669013 | | 5/1992 |
| WO | WO 9855384 | | 12/1998 |
| WO | WO0047503 | | 8/2000 |
| WO | WO0066470 | | 11/2000 |

OTHER PUBLICATIONS

World Intellectual Property Organization Ser. No. WO 98/52857, Nov. 26, 1998.

International Search Report, Feb. 21, 2003.

U.S. Pat. application entitled Center/Surface Rewinder and Winder, Ser. No. 10/085,813, Attorney Docket No. KCX–450 (16960), Filed on Feb. 28, 2002.

Partial International Search Report, Jun. 12, 2002.

* cited by examiner

MANDRELLESS CENTER/SURFACE REWINDER AND WINDER

BACKGROUND

Web "winders" are typically used to form large rolls of wound paper known as parent rolls. From the parent rolls, "rewinders" are employed in order to wind the web into a rolled product. The rolled product is then cut at designated lengths into the final product. Final products typically created by these machines and processes are toilet tissue rolls, paper toweling rolls, paper rolls, and the like.

There are essentially two types of techniques known in the art for performing the step of rewinding, that is winding the web from a parent roll into a rolled product. The first of these techniques is known as center winding. In center winding, a core is rotated in order to wind a web into a roll on the core. Typically, this core is mounted on a mandrel that rotates at high speeds at the beginning of a winding cycle and then slows down as the size of the rolled product being wound increases. Center winders work well when the web that is being wound has a printed, textured, or slippery surface. Also, center winders are very useful in producing softer rolled products.

The other type of technique used in winding a web to form a rolled product is known as surface winding. In surface winding, the web is wound onto the core via contact with belts and/or rotating rolls. A nip is typically formed between two or more co-acting belt systems. The belt systems typically travel in opposite directions at different speeds. The reason for having different speeds lies in the fact that a core that is being driven by the belts will advance in the direction of the faster moving belt. Usually, these belts are divergent so that the rolled product that is being built up on the core will have enough space to be produced, and will be able to contact the two diverging belts. Typically in surface winding, the core and the web that is wound around the core are driven by belts and/or rotating rolls that operate at approximately the same speed as the web speed.

In order to assist transfer of the web onto the core, it is known in the prior art to apply an uninterrupted line of glue or adhesive onto the core. The web will therefore contact this adhesive and adhere to the core as it is being wound onto the core.

In the prior art, a "winder" or reel is typically known as a device that performs the very first wind of that web, generally forming what is known as a parent roll. A rewinder, on the other hand, is a device that winds the web from the parent roll onto a roll that is essentially the finished product. However, the prior art is not consistent in designating what is and is not a winder or rewinder. For instance, rewinders are sometimes called winders, and winders are sometimes referred to as rewinders. It is to be understood that as used in the present application, the words "winder" and "rewinder" are interchangeable with one another in assessing the scope of the claims. In other words, the claims cover both "winders" and "rewinders" even though only one of these words may be used in the claims.

The prior art lacks a rewinder capable of performing both center winding and surface winding in order to take advantage of the positive attributes both processes enjoy.

SUMMARY

Objects and advantages of the invention will be set forth in part in the following description, or may be obvious from the description, or may be learned from practice of the invention.

The present application discloses a rewinder for winding a web to produce a rolled product. In one embodiment, the rewinder includes a web transfer device that conveys the web. The web transfer device communicates with a core in order to wind the web onto the core via surface winding. At least one pair of rotationally driven end chucks are also provided. The end chucks are located proximate to the web transfer device. The end chucks engage the core and the web is wound onto the core via center winding by the rotating end chucks. Also, the web is wound onto the core to form a rolled product by combination of the center winding and surface winding.

Another embodiment of the present invention includes a rewinder as discussed above which further has an applicator located proximate to the web transfer device for applying adhesive to the web.

In addition, the present invention may also have an embodiment as immediately discussed which further has a tension roll located upstream from the applicator. The tension roll engages the web and applies tension to the web.

Also disclosed according to the present invention, is an embodiment of a rewinder as originally discussed which further has an odd set of a plurality of rotationally driven end chucks. This rewinder also has an even set of a plurality of rotationally driven end chucks. The odd and even sets of end chucks are staggered such that when one pair of the odd set of end chucks finishes winding the web to produce a rolled product at the same time as one pair of the even set of end chucks begins winding the web to form another rolled product.

Also disclosed according to the present invention is another embodiment of a rewinder for winding a web to produce a rolled product. This rewinder has a web transfer device that is used for conveying the web. The web transfer device communicates with a core in order to wind the web onto the core. Also included is an air blast device that is located proximate to the web transfer device. The device delivers an air blast that aids in transferring the web from the web transfer device to the core. Further, an applicator is located upstream from the air blast device and is used for applying adhesive to the web. Also, a tension roll is located upstream from the applicator. The tension roll engages the web and applies tension to the web. Also, as is known in the art, the tension roll may sever the web on a part line for transfer from one wound log to the next.

Also disclosed is an embodiment of the rewinder as immediately discussed which further has an odd set of a plurality of rotationally driven end chucks. This rewinder also has an even set of a plurality of rotationally driven end chucks. The odd and even sets of end chucks are staggered such that when one pair of the odd set of end chucks finishes winding the web to produce a rolled product, one pair of the even set of end chucks begins winding the web to form another rolled product.

A still further embodiment of the present invention includes a rewinder as discussed above where adhesive is applied by the applicator to the leading edge of the web. This is facilitated in order to assist in the transfer of the web from the web transfer device onto the core. Another embodiment exists where adhesive is applied by the applicator to the trailing edge of the web in order to fix the trailing edge of the web onto the web that is wound on the core.

Yet another embodiment of the present invention includes a rewinder that is used for winding a web to produce a rolled product. This rewinder has a web transfer device that is used for conveying the web. An odd set of a plurality of rotationally driven end chucks are present. The odd set is located proximate to the web transfer device for engaging a core onto which the web is wound. An even set of a plurality of rotationally driven end chucks are also present. The even set is located proximate to the web transfer device and is used for engaging a core onto which the web is wound. Also, the positioning and rotation of the odd set of end chucks is controlled independently from the positioning and rotation of the even set of end chucks.

A still further embodiment of the present invention is an embodiment as immediately discussed where the sets of chucks are staggered so that when one pair of the odd set of end chucks finishes winding the web to produce a rolled product, one pair of the even set of end chucks begins winding the web to form another rolled product.

Another embodiment of the present invention exists in a rewinder as set forth above where the web is wound onto the core to form a rolled product by a combination of center winding from the end chucks and surface winding by the core and the web transfer device.

The present invention also provides for a rewinder that is used for winding a web to produce a rolled product. The rewinder includes a web transfer device for conveying the web. A core is located proximate to the web transfer device and the web is wound onto the core to form the rolled product. An applicator is located proximate to the web transfer device for applying adhesive to the web.

The present invention also includes an embodiment of a rewinder as previously discussed where the applicator applies adhesive to the leading edge of the web to assist in transfer of the web from the web transfer device onto the core. The applicator also applies adhesive to the trailing edge of the web to fix the trailing edge of the web onto the web that is wound onto the core.

DETAILED DESCRIPTION

Figure 1A:
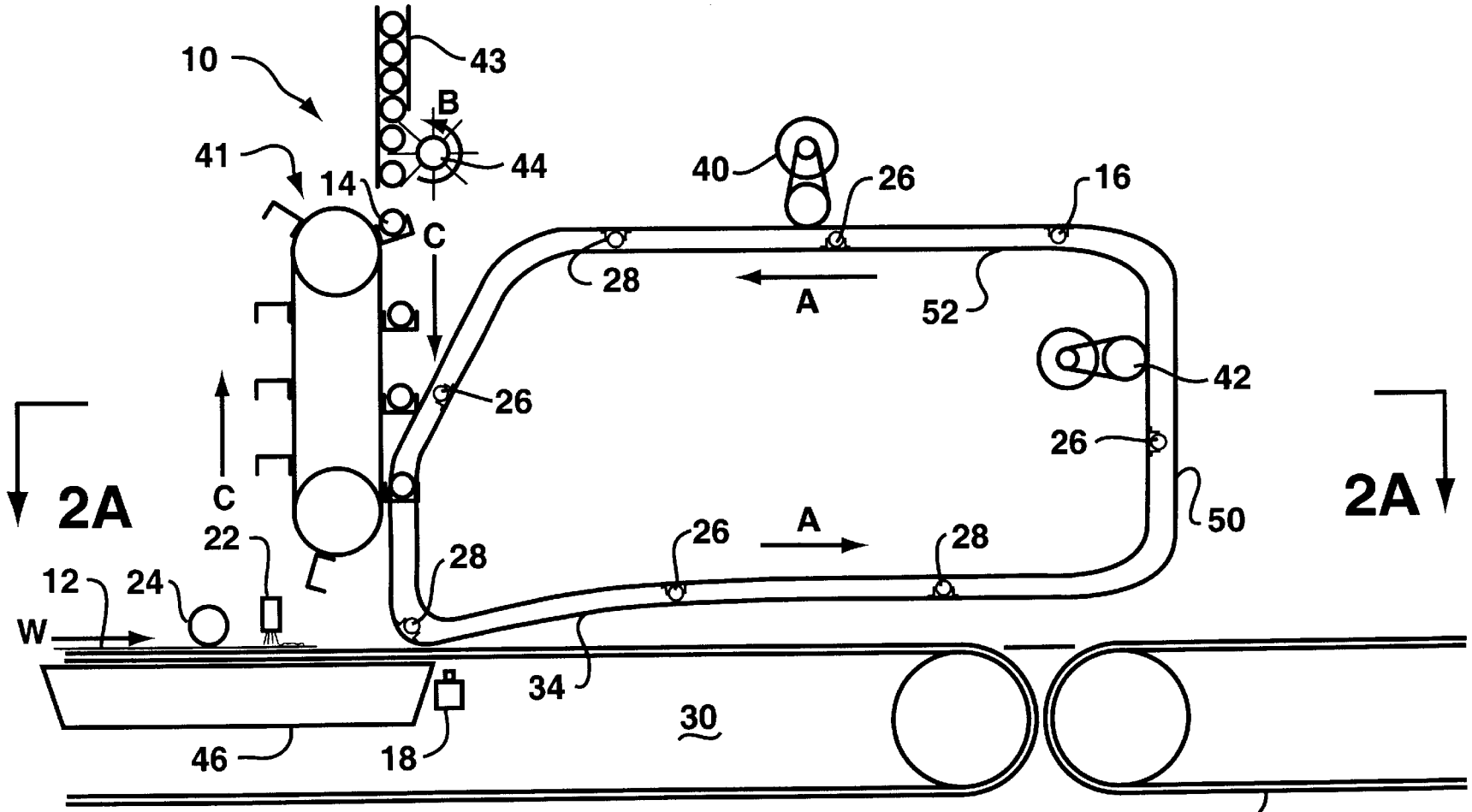
FIG. 1A is an elevation view of an embodiment of a rewinder of the present invention. The drawing shows a cam section in the odd and even transfer belts.

Reference will now be made in detail to embodiments of the invention, one or more examples of which are illustrated in the drawings. Each example is provided by way of explanation of the invention and is not meant as a limitation of the invention. For example, features illustrated or described as part of one embodiment can be used with another embodiment to yield still a third embodiment. It is intended that the present invention include these and other modifications and variations.

Figure 1B:
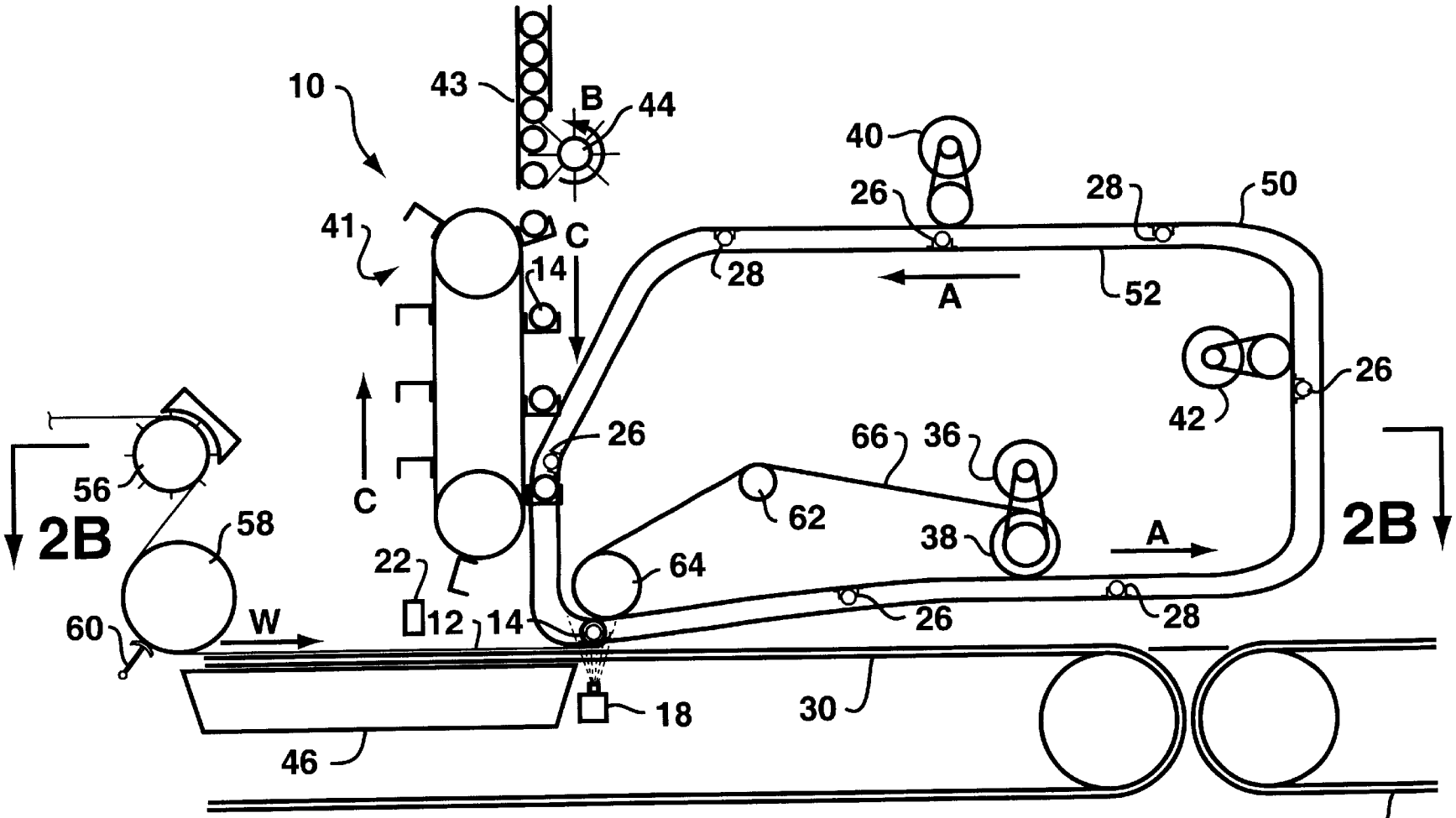
FIG. 1B is an elevation view of an embodiment of a rewinder in accordance with the present invention. The drawing shows the rewinder being used in association with a chuck rotation mechanism, a perforator, and a vacuum transfer roll with a cutting paddle.
Figure 1C:
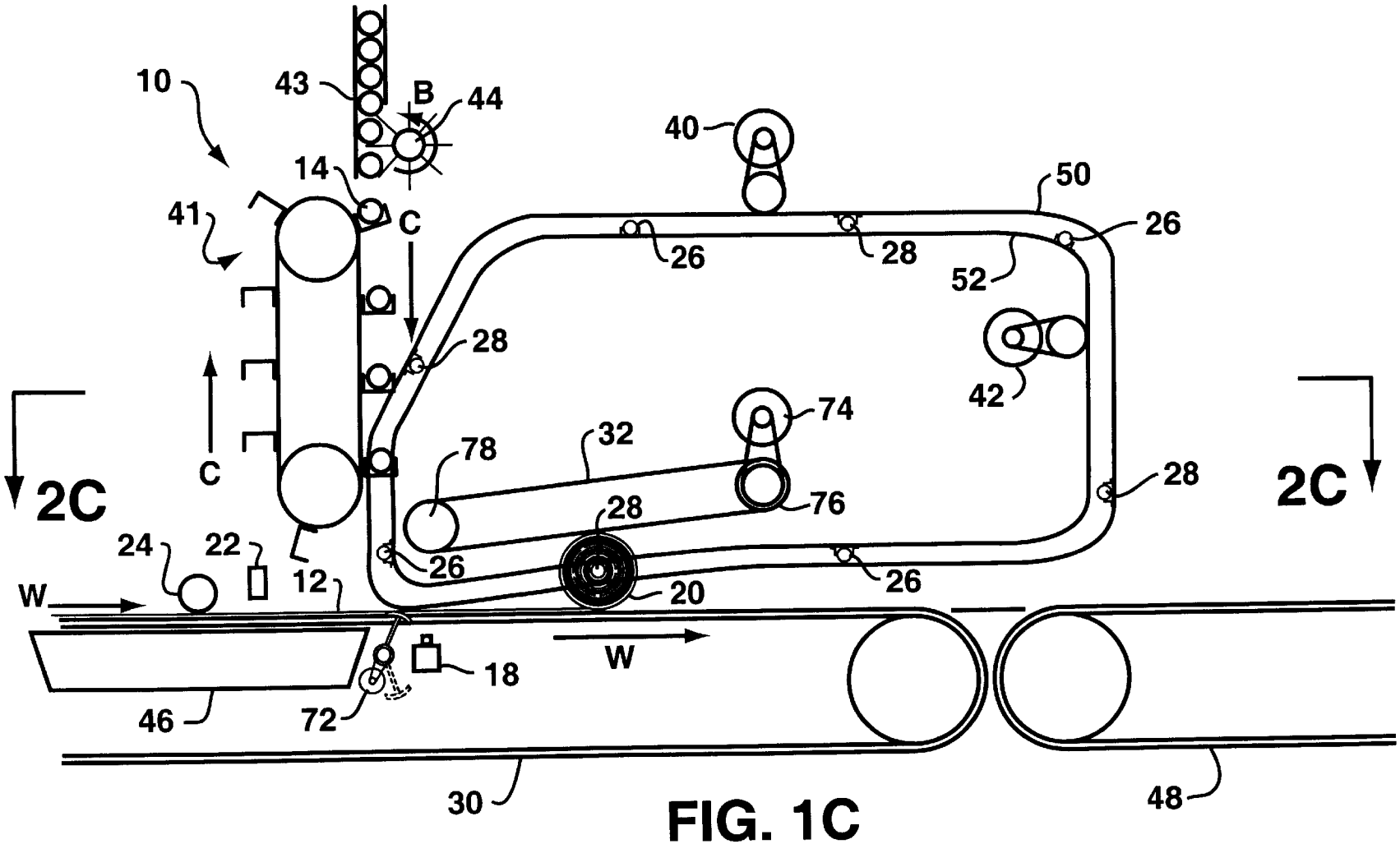
FIG. 1C is an elevation view of another embodiment of a rewinder in accordance with the present invention. The drawing shows the rewinder in association with a transfer assist device and a winding belt.
Figure 1D:
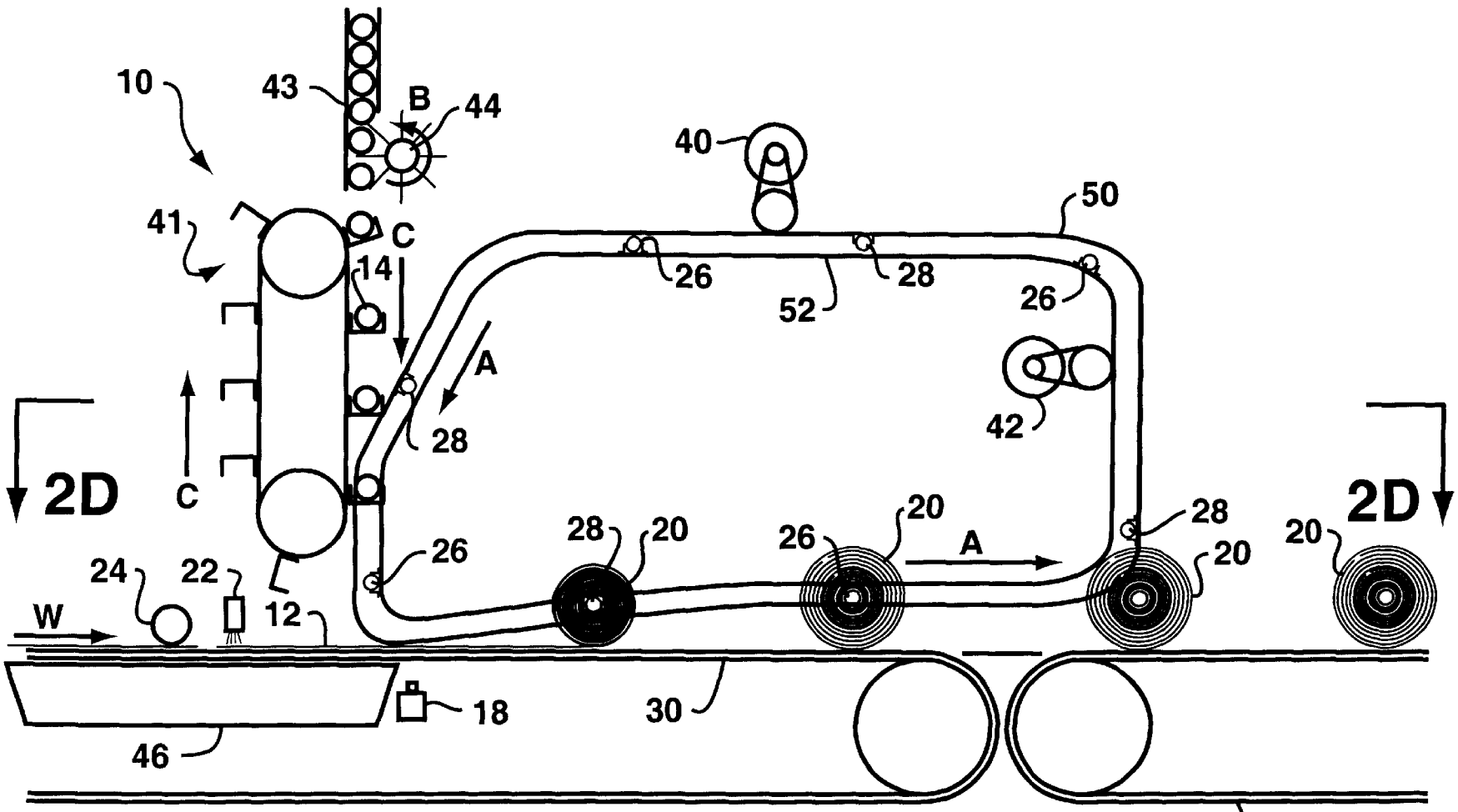
FIG. 1D is an elevation view of another embodiment of a rewinder of the present invention. The drawing shows a rolled product being wound onto a core and other finished rolled products being transferred by the rewinder and the rolled product transfer device.

Referring now to the drawings, FIG. 1A shows a rewinder 10 for use in winding a web 12 to produce a rolled product 20 (as seen in FIG. 1C and FIG. 1D). The rolled product 20 that may be produced can be of any number of types of products such as hand towels, toilet tissue, paper towels, or the like. The web 12 is shown in FIG. 1A as being transported by a web transfer device 30 in the direction indicated by arrow W. The web 12 that is shown being transported may be downstream from a parent roll (not shown) or downstream from a tissue machine or the like (not shown). The web transfer device 30 that transports the web 12 may be a vacuum bedroll or a vacuum conveyor. Such a device is advantageous in that it can hold the web 12 onto the surface of the web transfer device 30 without damaging the web 12.

The web 12 is transported by the web transfer device 30 into contact with a tension roll 24. An applicator 22 is present downstream from the tension roll 24. In one embodiment, the tension roll 24 may be used to increase the tension on the web 12 and therefore allow for a more advantageous application of adhesive by the applicator 22. Adhesive may be applied to the web 12 at the leading edge of the web 12 so that the web 12 will become securely engaged with a core 14 as the web 12 is wound around the core 14. Also, adhesive may be applied by the applicator 22 to the tailing edge of the web 12 so that the web 12 will be adhered to itself once the web 12 is completely wound around the core 14 to produce the rolled product 20.

The tension roll 24 may also be used in order to break the web 12. However, it is to be understood that other means of breaking the web 12 may be employed such as for instance by a cutting paddle 60. Additionally, it is not necessary that the tension roll 24 be used to break the web 12.

A basin 46 is present and may be used to collect extraneous adhesive or other matter, or may be a vacuum plenum that holds the leading edge of the web 12 from cut-off to core 14. An air blast device 18 is shown being proximate to the basin 46 and below the surface of the web transfer device 30. The purpose of air blast device 18 is to produce an air blast to urge the leading edge of the web 12 up to and in contact with the core 14.

Cores 14 are delivered to the rewinder 10 via a core unloading device 43. A wheel 44 is present that rotates in the direction of arrow B in FIG. 1A. Wheel 44 engages the cores 14 and the core unloading device 43 and places them in a controlled manner within a holder on the core transfer device 41. The core transfer device 41 rotates in the direction of arrow C in FIG. 1A. It can be seen from FIG. 1A that the core transfer device 41 moves cores 14 into close proximity with an even transfer belt 50 and an odd transfer belt 52.

Figure 2A:
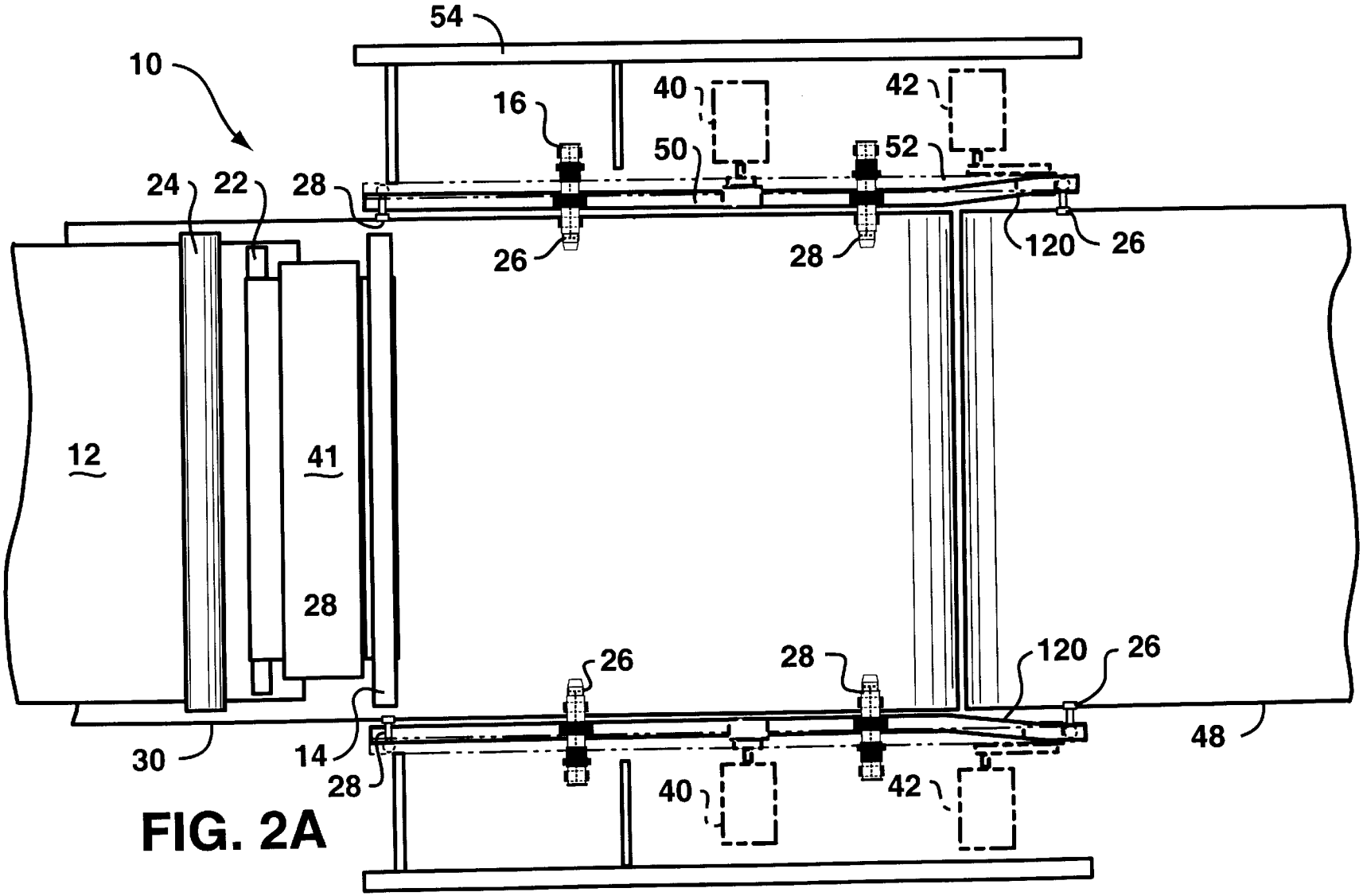
FIG. 2A is a plan view looking in the direction of lines 2A in FIG. 1A.

The even transfer belt 50 and odd transfer belt 52 have a plurality of end chucks, indicated generally at 16, located thereon such that the end chucks 16 are transported by the odd and even transfer belts 52 and 50. The direction of the end chucks 16 is indicated by arrow A in FIG. 1A. The end chucks 16 are divided into a set of even end chucks 28 and a set of odd end chucks 26. The even end chucks 28 and odd end chucks 26 are offset from one another as can be seen in FIG. 2A.

The even transfer belt 50 is driven by a variable speed drive 40, and the odd transfer belt 52 is driven by a variable speed drive 42. The variable speed drives 40 and 42 therefore allow for the positioning of the end chucks 16. The variable speed drives 40 and 42 may be controlled such that precise speed and direction of the end chucks 16 is achieved. The even set of end chucks 28 and odd set of end chucks 26 have their locations shown in FIG. 2A. However, it is to be understood that the configuration of the end chucks 16 themselves may be modified as is commonly known in the art. Also, the arrangement of the even transfer belt 50 and the odd transfer belt 52 may also be modified from the embodiment shown in FIG. 2A. For instance, the belts may be expanded to a location designated as reference numeral 54. This has not been shown in FIG. 2A due to the fact that it would obstruct the viewing of the even set of end chucks 28 and odd set of end chucks 26.

The even transfer belt 50 and odd transfer belt 52 shown in FIG. 1A has a cam section 34. Cam section 34 is present in order to ensure the proper winding of a rolled product 20 (as seen in FIG. 1C). This is because a rolled product 20 will have its diameter grow at a different rate as it is rolled. The embodiment shown in FIG. 1A could have the horizontal velocity of the core 14 remain constant as the rolled product 20 is being rolled, but have the speed in the vertical direction varied in order to compensate for changes in the diameter growth rate. Cam section 34 therefore allows for the varying of the speed in the vertical direction of core 14 as the rolled product 20 is wound. However, it is to be understood that a cam section 34 is not necessary and that the varying diameter build rate of the rolled product 20 may be controlled by other means. For instance, it could be possible to vary the speed of the core travel in the horizontal direction (relative to the surface of the web transfer device 30) by proper timing of the variable speed drives 40 and 42 in order to adjust for the changes in the rolled product 20 build rate. In this instance, it may also be the case that the cam section 34 would not be present and that the core 14 would travel in a straight line at an angle to the horizontal plane (surface of the web transfer device 30).

A rolled product transfer device 48 is present and is located adjacent to the web transfer device 30 in FIG. 1A. Once formed, a rolled product 20 may be removed from the end chucks 16 and placed onto the rolled product transfer device 48. FIG. 2A shows one method of removing the rolled product 20 from the end chuck 16. The cam 120 is angled away from the rolled product transfer device 48 as the end chucks 16 come within close proximity to the roll transfer device 48. Doing so would remove the end chucks 16 from engagement with the core 14 and allow for the rolled product 20 to be removed from the rewinder 10.

FIG. 1B shows an embodiment of a rewinder 10 having a perforator 56 located upstream from the even transfer belt 50 and odd transfer belt 52. The perforator 56 is provided to place perforations into web 12 so that individual sheets may be separated once the rolled product 20 is formed. Located downstream from the perforator 56 is a vacuum transfer roll 58. Vacuum transfer roll 58 is vacuum supplied so that the web 12 may be transferred around a partial circumference of the vacuum transfer roll 58. The cutting paddle 60 is provided adjacent to the vacuum transfer roll 58 and is used to sever the web 12 so that individual rolled products 20 may be formed. FIG. 1B also shows the web 12 at a point where engagement with a core 14 occurs. The air blast device 18 is activated in order to help urge the web 12 against the core 14. As previously indicated, adhesive may be applied to the leading edge of web 12 in order to help secure the web 12 onto the core 14 during winding. FIG. 1B also shows a chuck rotation mechanism 66 that is used to affect rotation of the end chucks 16. This rotation is only needed in the section of the even transfer belt 50 and odd transfer belt 52 in which winding takes place. In the embodiment shown in FIG. 1B there is no reason for the end chucks 16 to be rotated other than during the point where winding takes place, although it is to be understood that the present invention is not limited to having the end chucks 16 rotate only during the winding of the rolled product 20.

Figure 2B:
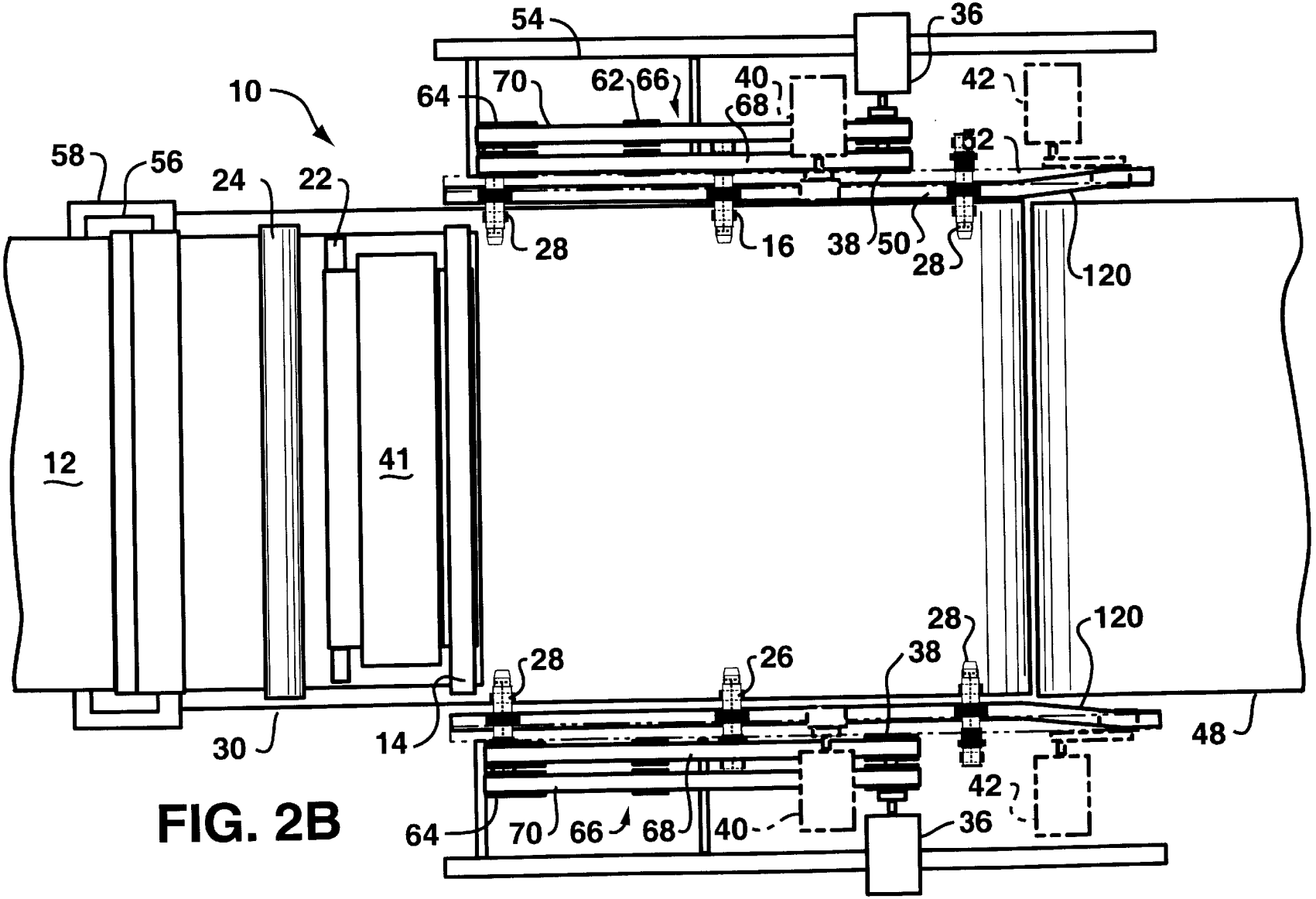
FIG. 2B is a plan view taken along line 2B of FIG. 1B.
Figure 2C:
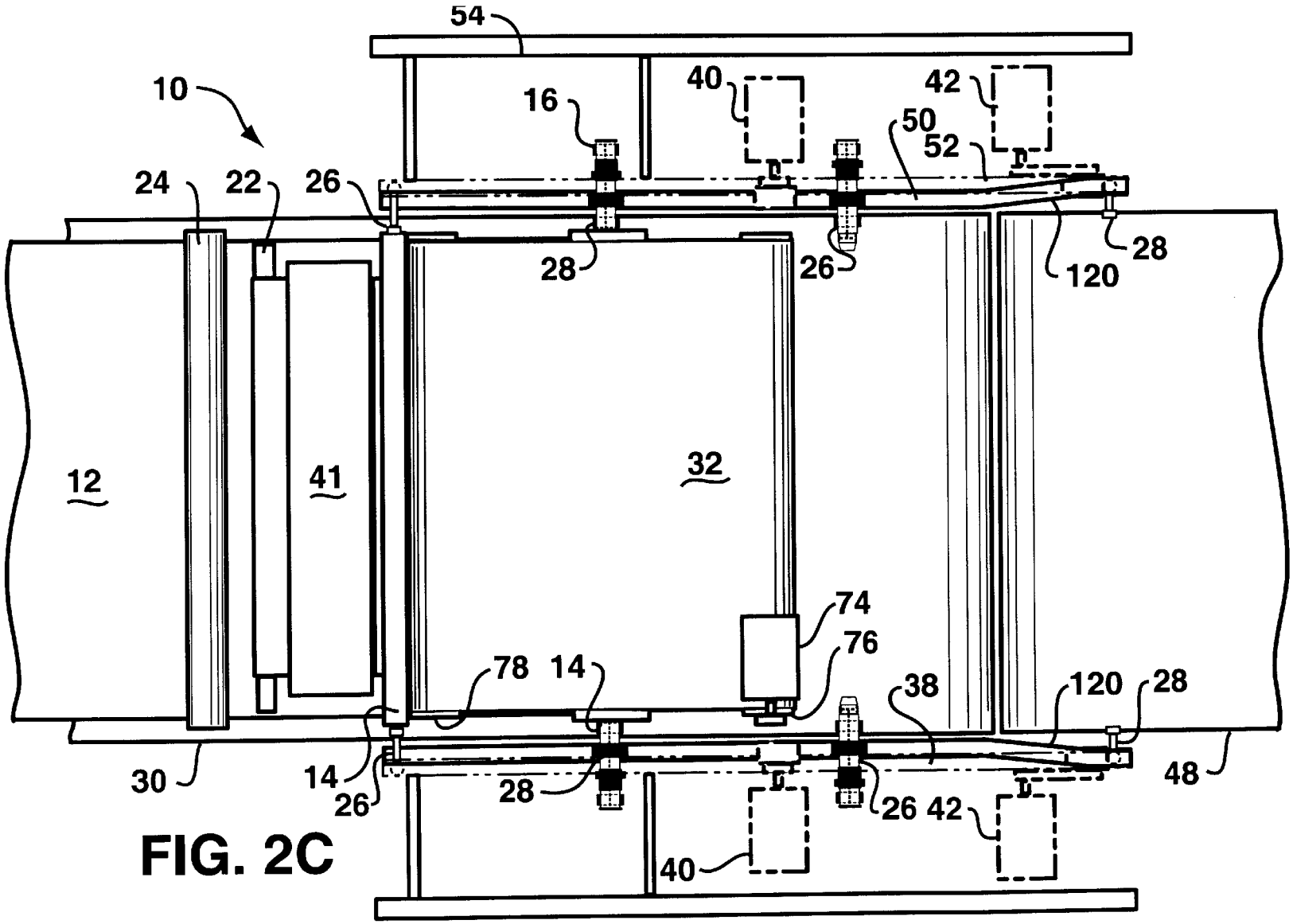
FIG. 2C is a plan view taken along line 2C of FIG. 1C.

The chuck rotation mechanism 66 is comprised of chuck rotation rolls 62 and 64. In communication with the chuck rotation rolls 62 and 64 is a variable speed drive 36. The variable speed drive 36 may also have a roll associated therewith so that an even rotation belt 70 is looped around these three rolls, and driven by the variable speed drive 36. Offset from the even rotation belt 70 is an odd rotation belt 68 that is looped around the chuck rotation roll 64 and 62 in addition to a variable speed drive 38 which may have a roll associated therewith. FIG. 2B shows this arrangement wherein the motor that runs the variable speed drive 38 is not shown for purposes of clarity. It may also be the case that the odd rotation belt 68 and even rotation belt 70 are driven by the same variable speed drive, however the embodiment in FIG. 2B has them being driven by separate drives 36 and 38.

Figure 3A:
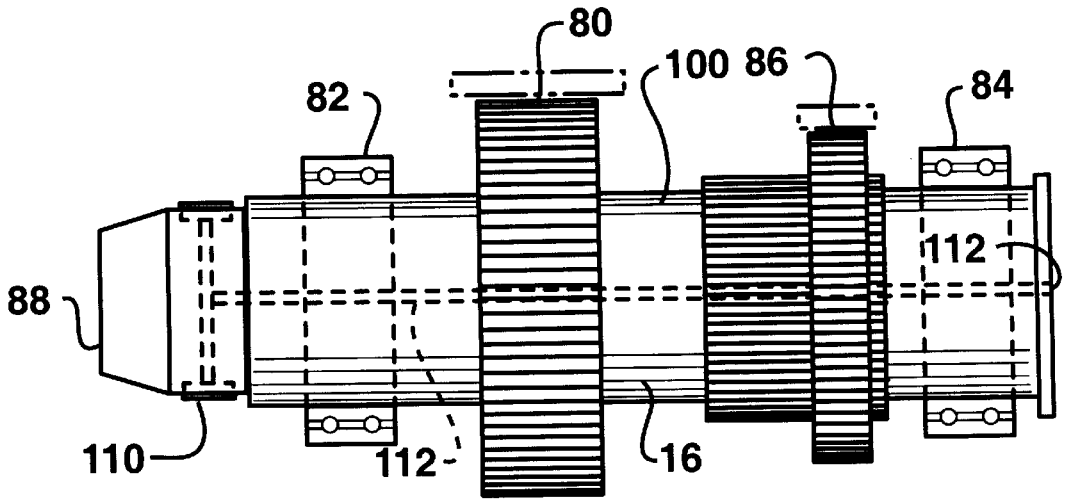
FIG. 3A is an elevation view of an end chuck in accordance with the present invention.

The end chucks 16 are moved along the even transfer belt 50 and odd transfer belt 52 in a manner disclosed previously for the embodiment shown in FIG. 1A. Upon reaching the point where the web 12 is transferred to the core 14, the core 14 and one set of end chucks 16 (that being an even set of end chucks 28 in FIG. 1B) are then placed in contact with the even rotation belt 70. The even pair of end chucks 28 has a drive belt pulley 80 in communication therewith so that the even pair of end chucks 28 are rotated once the drive belt pulley 80 contacts the even rotation belt 70. A drive belt pulley 80 on an end chuck 16 may be configured for instance as shown in FIG. 3A. Therefore, the even set of end chucks 28 are rotated during the time in which the rolled product 20 is wound. Once the rolled product 20 is wound, the engagement with the even rotation belt 70 is no longer present, and the even set of end chucks 28 are no longer rotationally driven. The rotation of the odd set of end chucks 26 is affected in a similar manner. However, the positioning of the drive belt pulley 80 is located at a different location of the odd set of end chucks 26 as the even set of end chucks 28. This is due to the offsetting of the odd rotation belt 68 and even rotation belt 70. As can been seen, the odd rotation belt 68 and even rotation 70 may be driven at different rotational speeds. Also, they may be independently controlled where if one rotation belt becomes disabled, the rewinder 10 can continue operations with the working rotation belt to produce rolled product 20 without interruption of the rewinder 10.

In addition to having an air blast from air blast device 18 assist in the transfer of the web 12 onto the core 14, a transfer assist device 72 as shown in FIG. 1C may also be employed. The transfer assist device 72 may be for instance an eccentric cam that can be used to deflect the belt of the web transfer device 30 and the web 12 transferred thereon up onto the core 14. However, it is to be understood that a web 12 may be transferred onto the core 14 simply by having the core 14 being pressed down onto web transfer device 30 in order to press against the web 12 which has adhesive applied thereto.

As indicated, the roll product 20 may be formed by having the end chucks 16 engage the core 14 and rotate the core 14 having a leading edge of web 12 attached thereto. This winding is known in the art as center winding, and will form a rolled product 20 by wrapping the web 12 about itself Surface winding may also be employed in conjunction with or alternatively to the embodiments of the present invention. Surface winding of the web 12 can be affected by a combination of the core 14 with the web transfer device 30. Contact of these two will cause a nip to be formed between the web transfer device 30 and the core 14 therefore causing surface winding of the web 12 about the core 14. As can be seen, the rolled product 20 can be formed by either center winding, surface winding, or a combination of center and surface winding. As previously discussed, this versatility allows for the rewinder 10 to produce rolled products 20 having varying characteristics. Production of rolled products 20 in this manner may therefore allow for the rewinder 10 to eliminate the winding of parent rolls and the subsequent unwinding of parent rolls.

A winding belt 32 may also be employed in the rewinder 10. Such a winding belt 32 is disclosed in FIG. 1C. The winding belt 32 can be used to assist with the driving of the core 14 to wind the web 12. The winding belt 32 is positioned proximate to the area of winding of the rolled product 20. Winding belt 32 is composed of winding belt rolls 76 and 78 and is driven by a winding belt drive 74. A winding belt 32 is positioned at an angle relative to the web transfer device 30 in order to compensate for rolled product 20 growth during the winding. In some embodiments of the present invention, it may be the case that the winding belt 32 may wind the web 12 onto the core 14 without use of a center winding effect by the end chucks 16. Here, the end chucks 16 would simply control the positioning of the core 14. Also, a winding belt 32 may be used to stabilize the rolled product 20 as it is being wound.

The rewinder 10 therefore allows for a combination center/surface winding of web 12 to form the rolled products 20 which are the finished product consumer rolls. However, a winding belt 32 is not necessary in order to achieve this result.

As stated, the applicator 22 is provided in order to apply adhesive to the leading edge of the web 12. The same applicator 22 or a second applicator (not shown) could be used to apply adhesive to the trailing edge of the web 12 in order to seal the tail of the rolled product 20. The benefits of having the applicator 22 apply adhesive directly to the web 12 could be for instance the elimination of having adhesive fly from the core 14 prior to the transfer of the web 12 onto the core 14. Also advantageous in such an embodiment is the elimination of a secondary process step for applying adhesive to the tail of the web 12.

FIG. 1D shows several rolled products 20 being produced by the rewinder 10. It can be seen that the end chucks are positioned such that once the winding of one of the rolled products 20 is complete, another of the end chucks 16 and core 14 are positioned to engage the leading edge of a web 12. In other words, as soon as one of the rolled products 20 is completed, winding of another rolled product 20 begins. However, it is to be understood that such an arrangement is not a limiting feature of the invention.

Due to the fact that the rolled product 20 will have a smaller diameter during the beginning of winding, it may be necessary for some embodiments of the present invention to have the end chucks 16 rotated at a faster rate once winding starts. Once the rolled product 20 reaches a larger diameter, it builds slower so the rotation of the end chucks 16 may be slowed down in order to compensate.

The end chuck 16 described in the present invention may be configured, for instance, as shown in FIG. 3A. The end chucks 16 are comprised primarily of a cylindrical rod 100 that is housed within bearings 82 and 84. Bearings 82 and 84 may be connected to the even or odd transfer belts 50 and 52 so that the end chuck 16 can rotate relative to the even or odd transfer belt 50 and 52. As previously discussed, the rotation of the end chuck 16 is affected by the contact of either the odd or even rotation belts 68 and 70 with the drive belt pulley 80. Engagement of the drive belt pulley 80 with one of these belts causes the end chuck 16 to rotate due to a secured connection between the drive belt pulley 80 and the cylindrical section 100 of the end chuck 16.

Figure 3B:
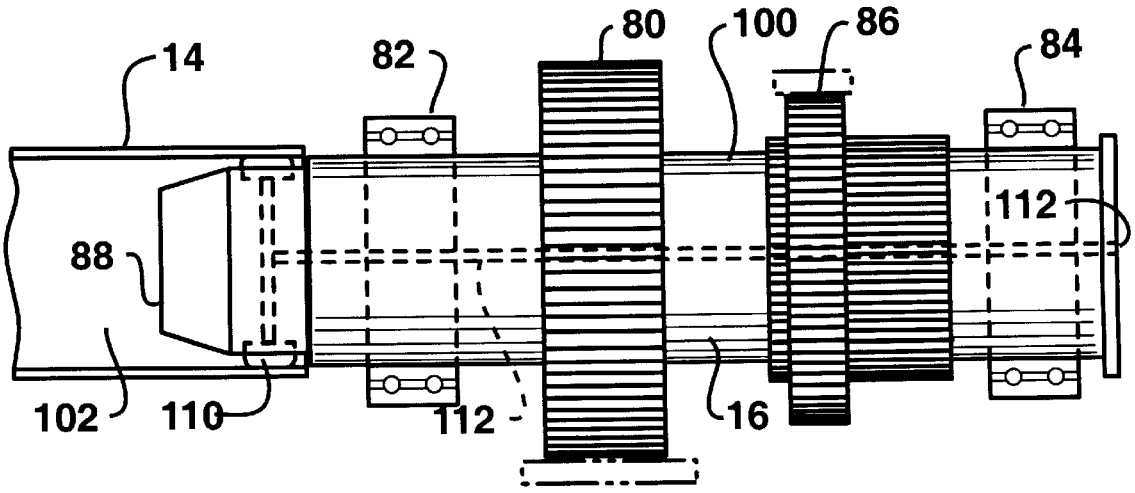
FIG. 3B is an elevation view of an end chuck in accordance with the present invention. The end chuck is shown engaging a core.

In order to engage the core 14, the end chucks 16 must be inserted into the hollow cavity 102 of the core 14. An end chuck 16 is inserted into each end of the hollow cavity 102 of the core 14. Such an insertion on one end of the hollow cavity 102 is shown in FIG. 3B. In order to move the end chuck 16 into the hollow cavity 102 of the core 14, a drive gear or pulley 86 is employed. The drive gear or pulley 86 is configured to contact another belt system (not shown) similar to that of the chuck rotation mechanism 66. Here however, rotation of the drive gear or pulley 86 causes the end chuck 16 to move linearly with respect to the core 14. This is due to the fact that the drive gear or pulley 86 has an internal spline which is geared with the cylindrical section of the end chuck 16. Therefore, the rotational movement of the drive gear or pulley 86 is translated into linear movement of the end chuck 16.

The end chuck 16 has a tip 88. Tip 88 is tapered in order to allow for some error in the insertion of the end chuck 16 into the core 14. As shown in FIGS. 3A and 3B, a bladder arrangement 110 is located adjacent to the tip 88. In one embodiment of the present invention, the bladder arrangement 110 is provided with a pneumatic line 112. Once inserted into the core 14, the pneumatic line 112 provides pressure into the bladder arrangement 110 so that the bladder arrangement 110 expands and engages the inner circumference of the core 14 to securely hold the core 14 and translate the rotation of the end chucks 16 to the core 14.

Figure 2D:
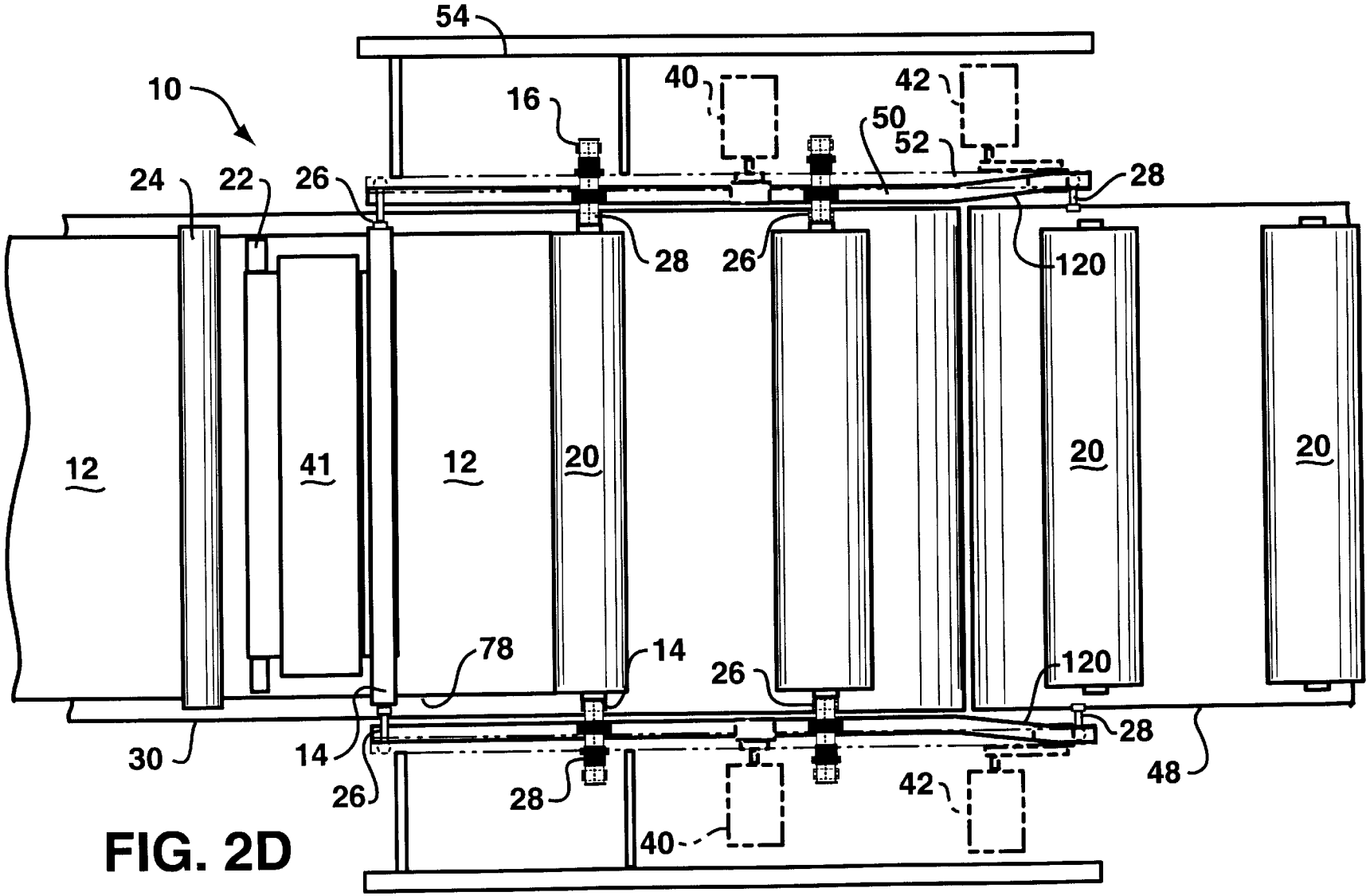
FIG. 2D is a plan view taken along line 2D of FIG. 1D.

Once the rolled product 20 is completely wound, the pressure imposed on the bladder arrangement 110 is removed. This causes the rotation of the end chuck 16 to no longer transmit to the core 14. The drive gear or pulley 86 may be engaged by another belt system (not shown) in order to affect a linear withdrawal of the tip 88 of the chuck 16 from the hollow cavity of the core 14. Also, as shown in FIG. 2D, core chuck position cam 120 may in one embodiment be simply angled away from the web transfer device 30 such that the end chucks 16 are pulled out of the core 14. It is to be understood in the present invention that various ways of engaging and disengaging the end chucks 16 from the core 14 are possible. Also, the two techniques disclosed may be combined with themselves or with other ways to effect these engagements and disengagements.

It should be understood that the invention includes various modifications that can be made to the embodiments of the mandrelless center/surface rewinder described herein as come within the scope of the appended claims and their equivalents.

What is claimed is:

1. A rewinder for winding a web to produce a rolled product comprising:

a web transfer device for conveying a web, the web transfer device communicating with a core in order to wind the web onto the core via surface winding;

at least one pair of rotationally driven end chucks located proximate to the web transfer device, the end chucks engaging the core whereby the web is wound onto the core via center winding by the rotating end chucks; and wherein the web is wound onto the core to form a rolled product by a combination of the center winding and the surface winding.

2. The rewinder as set forth in claim 1, further comprising an applicator located proximate to the web transfer device for applying adhesive to the web.

3. The rewinder as set forth in claim 2, further comprising a tension roll located upstream from the applicator, the tension roll engaging the web and applying tension to the web.

4. The rewinder as set forth in claim 2, wherein adhesive is applied by the applicator to the leading edge of the web to assist in transfer of the web from the web transfer device onto the core, and adhesive is applied by the applicator to the trailing edge of the web to fix the trailing edge of the web onto the web that is wound on the core.

5. The rewinder as set forth in claim 1, further comprising an odd set of a plurality of rotationally driven end chucks and an even set of a plurality of rotationally driven end chucks, the odd and even sets of end chucks staggered such that when one pair of the odd set of end chucks finishes winding the web to produce a rolled product, one pair of the even set of end chucks begins winding the web to form another rolled product.

6. The rewinder as set forth in claim 5, wherein the odd set of end chucks and the even set of end chucks have variable speed drives to control the position of the end chucks and rotation of the end chucks.

7. The rewinder as set forth in claim 1, wherein the web transfer device is a vacuum belt.

8. The rewinder as set forth in claim 1, further comprising an air blast device located proximate to the web transfer device for aiding transfer of the web from the web transfer device to the core.

9. The rewinder as set forth in claim 1, further comprising a winding belt for assisting the web transfer device in surface winding the web onto the core, the core is located between the winding belt and the web transfer device while the web is wound onto the core to form a rolled product.

10. The rewinder as set forth in claim 1, further comprising a cam communicating with the end chucks to move the end chucks and the core, the end chucks are urged against the cam in a vertical direction to compensate for changes in the diameter of the web wound onto the core.

11. The rewinder as set forth in claim 1, wherein the speed of the core travel in the horizontal direction is varied during winding of the web onto the core in order to compensate for changes in the diameter of the web wound onto the core.

12. The rewinder as set forth in claim 1, further comprising a bladder arrangement located on the end chucks to engage the core onto which the web is wound.

13. A rewinder for winding a web to produce a rolled product having a core, comprising:

a web transfer device for conveying a web, the web transfer device communicating with a core in order to wind the web onto the core to form a rolled product having the core;

an air blast device located proximate to the web transfer device for aiding transfer of the web from the web transfer device to the core;

an applicator located upstream from the air blast for applying adhesive to the web; and a tension roll located upstream from the applicator, the tension roll engages the web and applies tension to the web;

wherein the web is wound onto the core by a combination of center winding and surface winding.

14. The rewinder as set forth in claim 13, wherein the web transfer device is a vacuum belt.

15. The rewinder as set forth in claim 13, further comprising an odd set of a plurality of rotationally driven end chucks and an even set of a plurality of rotationally driven end chucks, the odd and even sets of end chucks staggered such that when one pair of the odd set of end chucks finishes winding the web to produce a rolled product, one pair of the even set of end chucks begins winding the web to form another rolled product.

16. The rewinder as set forth in claim 13, wherein the applicator is disposed to apply adhesive to the leading edge of the web to assist in transfer of the web from the web transfer device onto the core.

17. The rewinder as set forth in claim 16, wherein adhesive is further applied by the applicator to the trailing edge of the web to fix the trailing edge of the web onto the web that is wound on the core.

18. A rewinder for winding a web to produce a rolled product comprising:

a web transfer device for conveying a web;

an odd set of a plurality of rotationally driven end chucks located proximate to the web transfer device for engaging a core onto which the web is wound;

an even set of a plurality of rotationally driven end chucks located proximate to the web transfer device for engaging a core onto which the web is wound; and wherein the positioning and rotation of the odd set of end chucks is controlled independently from the positioning and rotation of the even set of end chucks.

19. The rewinder as set forth in claim 18, wherein the sets of chucks are staggered so that when one pair of the odd set of end chucks finishes winding the web to produce a rolled product, one pair of the even set of end chucks begins winding the web to form another rolled product.

20. The rewinder as set forth in claim 18, wherein the odd set of end chucks and the even set of end chucks have variable speed drives to control the position of the end chucks and the rotation of the end chucks.

21. The rewinder as set forth in claim 18, further comprising a bladder arrangement located on the end chucks to engage the core onto which the web is wound.

22. The rewinder as set forth in claim 18, wherein the web transfer device is a vacuum belt.

23. The rewinder as set forth in claim 18, further comprising an air blast device located proximate to the web transfer device for aiding transfer of the web from the web transfer device to the core.

24. The rewinder as set forth in claim 18, wherein the speed of the core travel in the horizontal direction is varied during winding of the web onto the core in order to compensate for changes in the diameter of the web onto the core.

25. A rewinder for winding a web to produce a rolled product comprising:

a web transfer device for conveying a web;

an odd set of a plurality of rotationally driven end chucks located proximate to the web transfer device for engaging a core onto which the web is wound;

an even set of a plurality of rotationally driven end chucks located proximate to the web transfer device for engaging a core onto which the web is wound;

wherein the positioning and rotation of the odd set of end chucks is controlled independently from the positioning and rotation of the even set of end chucks; and wherein the web is wound onto the core to form a rolled product by a combination of center winding from the end chucks and surface winding by the core and web transfer device.

26. A rewinder for winding a web to produce a rolled product comprising:

a web transfer device for conveying a web;

an odd set of a plurality of rotationally driven end chucks located proximate to the web transfer device for engaging a core onto which the web is wound;

an even set of a plurality of rotationally driven end chucks located proximate to the web transfer device for engaging a core onto which the web is wound;

wherein the positioning and rotation of the odd set of end chucks is controlled independently from the positioning and rotation of the even set of end chucks;

a winding belt disposed to wind the web onto the core via surface winding, the core is located between the winding belt and the web transfer device while the web is wound onto the core to form a rolled product.

27. A rewinder for winding a web to produce a rolled product comprising:

a web transfer device for conveying a web;

an odd set of a plurality of rotationally driven end chucks located proximate to the web transfer device for engaging a core onto which the web is wound;

an even set of a plurality of rotationally driven end chucks located proximate to the web transfer device for engaging a core onto which the web is wound;

wherein the positioning and rotation of the odd set of end chucks is controlled independently from the positioning and rotation of the even set of end chucks; and a cam communicating with the end chucks to move the end chucks and the core, the end chucks are urged against the cam in a vertical direction to compensate for changes in the diameter of the web wound onto the core.

28. A rewinder for winding a web to produce a rolled product having a core comprising:

a web transfer device for conveying a web;

a core located proximate to the web transfer device onto which the web is wound onto the core to form a rolled product having the core; and an applicator located proximate to the web transfer device for applying adhesive to the web;

wherein the web is would onto the core by a combination of center winding and surface winding.

29. A rewinder for winding a web to produce a rolled product having a core comprising:

a web transfer device for conveying a web;

a core located proximate to the web transfer device onto which the web is wound onto the core to form a rolled product having the core; and an applicator located proximate to the web transfer device for applying adhesive to the leading edge of the web to assist in transfer of the web from the web transfer device onto the core, the applicator applies adhesive to the trailing edge of the web to fix the trailing edge of the web onto the web that is wound onto the core;

wherein the web is wound onto the core by a combination of center winding and surface winding.

* * * * *